United States Patent [19]

Gubitose

[11] 4,325,419

[45] Apr. 20, 1982

[54] APPARATUS FOR TRANSFERRING PURE ABRASIVE MATERIAL FROM ONE HOPPER TO ANOTHER

[75] Inventor: Nicholas F. Gubitose, Moosic, Pa.

[73] Assignee: RCA Corporation, New York, N.Y.

[21] Appl. No.: 198,591

[22] Filed: Oct. 20, 1980

[51] Int. Cl.[3] ..... B65B 1/28

[52] U.S. Cl. ..... 141/302; 137/614.17; 141/311 R; 141/392; 222/506

[58] Field of Search ..... 137/614.11, 614.17, 137/614.19; 141/1, 98, 284, 285, 301, 346–351; 363, 364, 311 R, 392, 302; 222/506, 545

[56] References Cited

U.S. PATENT DOCUMENTS 3,998,686 12/1976 Meiling et al. ..... 156/617 R 4,220,176 9/1980 Russell ..... 137/614.17 X

*Primary Examiner*—Frederick R. Schmidt

*Attorney, Agent, or Firm*—Birgit E. Morris; Donald S. Cohen; Robert P. Seitter

[57] ABSTRACT

Apparatus for transferring material from one vacuum tight hopper to another includes funnel means having a valve member at one end adjacent the one hopper for controlling flow and valve means the other end of the funnel means for similarly controlling flow. Between the other end of the funnel means and the valve means there is provided collector door means movable between open and closed positions to prevent the material to be transferred from impinging on the sealing surfaces of the valve means.

10 Claims, 3 Drawing Figures

APPARATUS FOR TRANSFERRING PURE ABRASIVE MATERIAL FROM ONE HOPPER TO ANOTHER

BACKGROUND OF THE INVENTION

This invention relates to apparatus for transferring material from one hopper to another and, more particularly, for transferring relatively pure abrasive material under conditions preventing contamination of the material and preventing the material from damaging various parts of the apparatus.

In processing abrasive, granular or powder materials, it is often necessary to transfer the material between work stations. Certain of these materials are easily contaminated and highly abrasive and these phenomena impose special requirements on the transfer apparatus. As an example, aluminum oxide ($Al_2O_3$) in granular or powder form is used in growing saphhire crystal for use as a substrate for various integrated circuits. Because of the stringent purity requirements of the electronics industry, this raw material is normally "outgassed" in a vacuum-tight hopper to remove oxygen, water, and other contaminants that may be contained therein. After outgassing, the now relatively pure material is transferred to a vacuum-tight feeding apparatus for feeding it to a crystal growing apparatus. Thus, it is a special requirement that the transfer apparatus between the hopper and the feeding apparatus be air-tight to prevent recontamination of the raw material.

This special requirement is complicated by the fact that the outgassing of aluminum oxide can take from 6 to 12 or more hours. It is thus desirable to outgas the aluminum oxide at a work station separated from the feeding apparatus so that the feeding apparatus and the crystal growing apparatus can operate while the material is outgassed. In addition, it is desirable that the outgassed material be transferable to the feeding apparatus without shutting down this apparatus. Thus, added to the special requirement above are the additional special requirements that the vacuum-tight hopper be easily connected to and disconnected from the feeding apparatus and that contamination of the raw material in the hopper and the feeding apparatus be prevented when the hopper is disconnected and when it is reconnected.

In addition, aluminum oxide is a highly abrasive material capable of destroying certain of the parts normally used in the construction of transfer apparatus. For example, the transfer apparatus may include a valve for controlling the flow of material from the hopper to the feeding apparatus. Such a valve would include a valve member, a valve seat and appropriate seals, all or any of which can be scored or marred on contact with even the smallest particle of aluminum oxide. If this scoring or marring occurs in the area of the valve sealing surfaces, the sealing integrity of the valve is lost. Thus, it is an additional special requirement that the transfer apparatus be arranged to prevent the material from impinging on sealing portions of the valve.

It should be understood that these special requirements are in addition to the usual requirements that the transfer apparatus be economical, rugged, reliable, relatively maintenance free, and easy to use.

SUMMARY OF THE INVENTION

This invention provides a transfer apparatus that concurrently satisfies all of the requirements set forth above. It includes first funnel means adapted to be mounted adjacent the bottom of a hopper containing raw material to be transferred. The first funnel means includes a through passage and a valve member adjacent the end closest to the bottom of the hopper and it is movable between a first position wherein the valve member prevents flow from the hopper and a second position wherein it allows flow therefrom. Adjacent the other end of the first funnel means is a valve means movable between a closed position preventing flow from the passage means and an open position allowing flow from the passage. Collector means is provided between the other end of the first funnel means and the valve means and it is movable between a closed position overlying the passage when the valve means is closed and an open position spaced from the passage to allow flow when the valve means is open. This collector means is made of a material that is not readily attacked by an abrasive material so that it functions to protect the valve means from damage.

On the discharge side of the valve means is a second funnel means having a through passage that communicates with the passage in the first funnel means so that material flowing through the valve means flows to the second funnel means. This second funnel means is adapted to communicate with a receiver such as the feeding apparatus of a crystal growing chamber and includes, adjacent the end closest to the receiver, a control valve means movable between a closed position preventing flow to the receiver and an open position allowing flow to the receiver. Gas inlet means communicates with the passage means in the second funnel means adjacent the control valve means and pressure relief valve means communicates with the passage in the second funnel means at a point adjacent the valve means. Thus, when the transfer mechanism is first connected to the receiver means the valve means and the control valve means are closed and the air trapped there-between can be purged by a stream of inert gas which will fill that space and prevent recontamination of the material fed therethrough.

BRIEF DESCRIPTION OF THE DRAWING

For a better understanding of the invention, reference is made to the following description of a preferred embodiment thereof, takes in conjunction with the figures of the accompanying drawing, in which.

DETAILED DESCRIPTION OF THE PREFERRED EMBODIMENT

Figure 1:
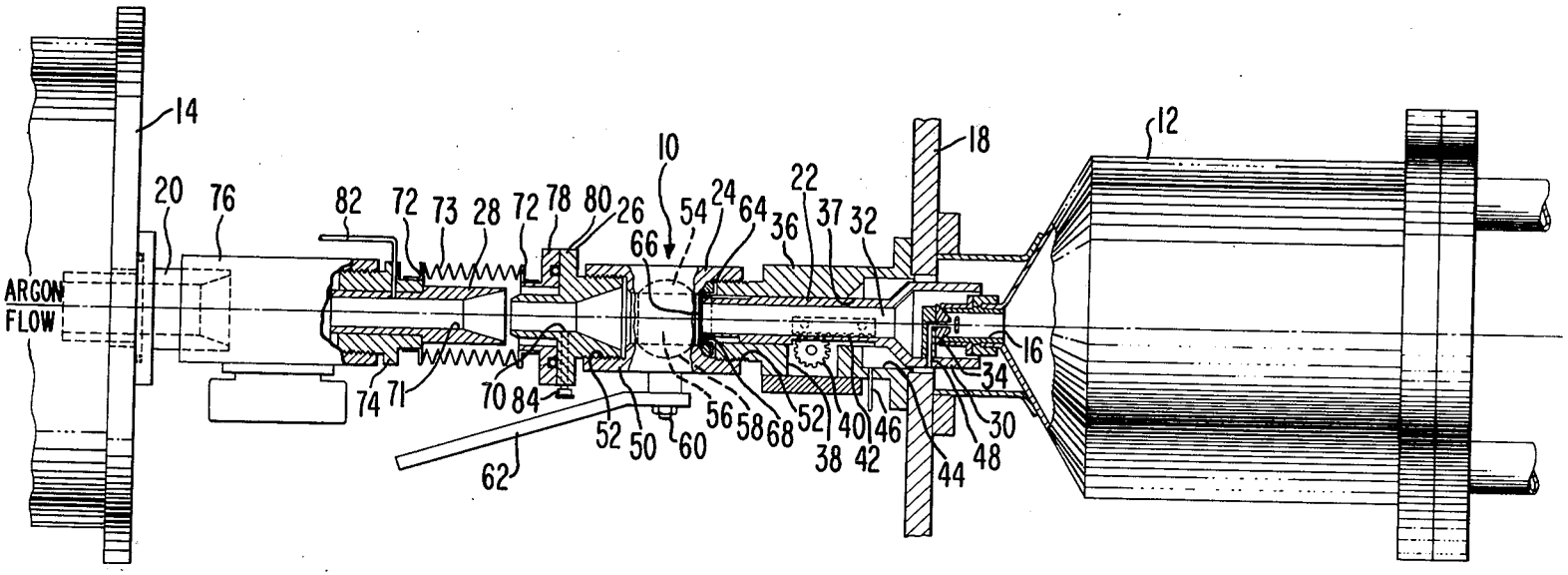
FIG. 1 is a section view along the longitudinal axis of a transfer apparatus in accordance with this invention connected between a supply hopper and a receiving hopper with the apparatus illustrated in a closed position to prevent the transfer of material.
Figure 2:
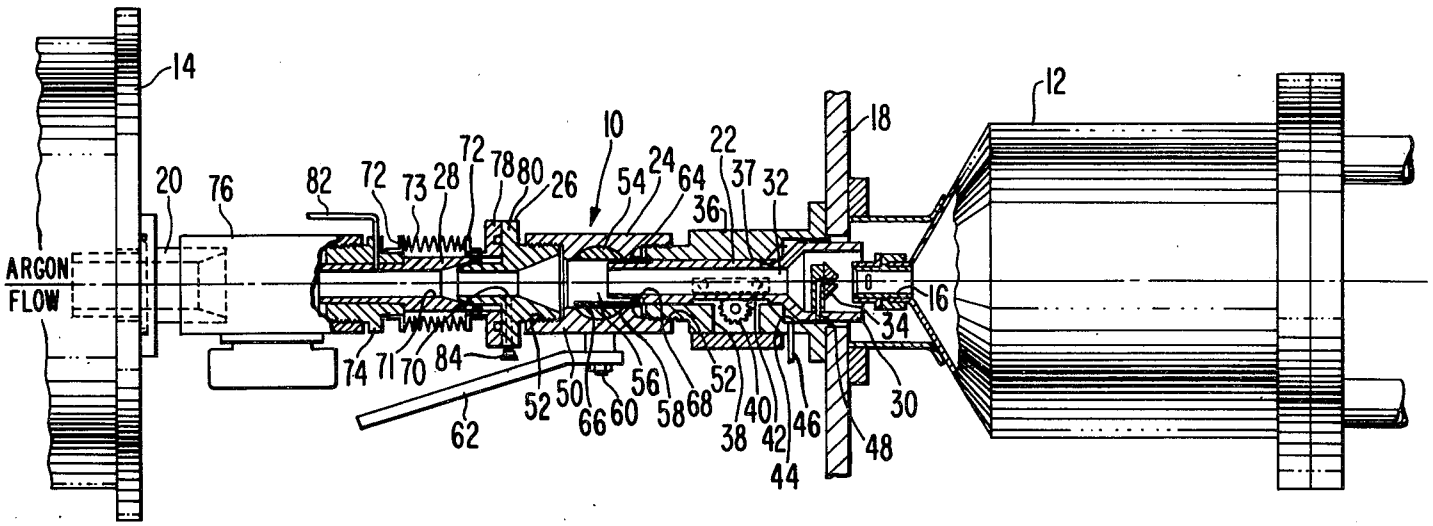
FIG. 2 is a section view similar to FIG. 1 showing the apparatus in an open position to transfer material; and, FIG. 3 is an enlarged section view of a ball valve means and collector means used in the apparatus of FIGS. 1 and 2.

Referring particularly to FIGS. 1 and 2 of the drawing, there is disclosed a transfer apparatus 10 generally in accordance with this invention connected between a first chamber, such as a supply hopper 12 containing granular or powder material, and a second chamber such as a feeding apparatus 14, to which the material is to be transferred. In the preferred embodiment of the invention disclosed herein, the supply hopper 12 is part of a system for outgassing, i.e., purifying, aluminum oxide, and can be a part of the apparatus disclosed in the copending application of Nicholas Francis Gubitose et al., Ser. No. 198,833 filed Oct. 20, 1980 and entitled METHOD OF AND APPARATUS FOR OUTGASSING RAW MATERIAL USED TO GROW CRYSTALS. The feeding device 14 can be of the type disclosed in U.S. Pat. No. 4,222,502 issued Sept. 16, 1980 to N. F. Gubitose et al. and entitled METER AND DISPENSING SYSTEM FOR ABRASIVE MATERIALS. Thus, in the supply hopper 12 is a supply of relatively pure, highly abrasive material which is to be transferred to the feeding apparatus 14 for feeding the material to a crystal growing apparatus. It should be understood, that the transfer must be accomplished without recontaminating the material and in such a way that the material does not destroy or damage any of the parts of the transfer apparatus 10.

The supply hopper 12 is formed adjacent its bottom surface with a discharge passage 16 and is carried on a suitable support plate 18 formed with an opening through which the transfer apparatus 10 extends. The feeding device 14 is formed with an inlet passage 20 extending through its top surface and which receives the material from transfer apparatus 10.

The transfer apparatus 10 comprises a plurality of main elements including a first funnel means 22, ball valve means 24, coupling means 26 and funnel member 28 which together with the coupling means forms a second funnel means. First funnel means 22 is in the form of an elongated generally cylindrical member having an enlarged diameter portion 30 at one end. A passage 32 extends through the funnel member 22 and, of course, has an enlarged diameter portion adjacent the enlarged diameter portion 30. The inner surface of the enlarged diameter portion 30 extends around and is radially spaced from the discharge passage 16 in the bottom of the supply hopper 12 so that the discharge passage 16 communicates with the passage 32 through the funnel means 22. Located adjacent the end of the funnel means 22 closest to the supply hopper 12 is a valve member 34 that cooperates with the free end of the discharge passage 16 to prevent or allow the flow of raw material from the hopper to the passage 32. In the position illustrated in FIG. 1 of the drawing, the valve member 34 is closed against the free edge of the discharge passage 16 to prevent flow. By moving the first funnel means 22 along it longitudinal axis, the valve member 34 is spaced from the free edge of the discharge passage 16, as illustrated in FIG. 2 of the drawing so that the material can flow through the discharge passage into the passage 32.

The movement of the first funnel means 22 is a reciprocating movement and to guide it, there is provided a housing member 36 mounted on the bottom of the support plate 18 and formed with a passage 37 in which the first means 22 is slidably supported. Along one side, the housing member 36 is formed with an enlarged opening 38 in which a pinion 40 is rotatably mounted for cooperation with a rack 42 carried on the outer surface of the first funnel means 22. The shaft on which the pinion 40 is secured extends through the wall of the housing member 36 so that it can be rotated by an operator. Rotation of the pinion 40 drives the rack 42 and, of course, the first funnel means 22 along the passage 37 toward or away from the supply hopper 12 depending on the direction of the rotation. Thus, the valve member 34 is opened or closed by the pinion 40 and rack 42.

At the end of the housing member 36 adjacent the hopper 12, the passage 37 is formed with an enlarged diameter portion 44 of sufficient axial length to accommodate the enlarged diameter portion 30 of the first funnel means as it is driven from the closed to the open position of the valve member 34. It can be seen that a chamber is formed between the enlarged diameter portion 44 of the housing member 36 and the enlarged diameter portion 30 of the first funnel means 22. Communicating with this chamber is a fitting 46 adapted to be connected to a source of inert gas such as argon. A passageway 48 is formed in the valve member 34 and it communicates with the chamber and with the interior of the hopper 12 so that the inert gas may be fed to the interior of the hopper. As explained in the concurrently filed application of Nicholas Francis Gubitose et al. referenced above, the inert gas is used during the outgassing technique carried out in the hopper 12. It should be specifically understood, of course, that if the argon feed is not used during outgassing, the fitting 46 and the pasageway 48 need not be provided.

The ball valve means 24 comprises a housing 50 formed with internally threaded bores 52 at opposite ends. One of the threaded bores 52 cooperates with an externally threaded portion on the end of the housing member 36 to secure the ball valve means 24 in position adjacent to the first funnel means 22. The ball valve means 24 further includes a ball member 54 formed with a through passage 56 and is rotatably mounted about an axis generally transverse to the longitudinal axis of the first funnel means 22 so that in its closed position the outer surface of the ball member 54 bears against a valve seat 58 and is adjacent to the end of the passage 32 to prevent flow. In the open position of the ball valve means 24, the ball member 54 is oriented such that the through passage 56 is aligned with the passage 32 in the first funnel means 22 to allow flow therethrough. Rotation is accomplished, as is usual, by a stem 60 fixed to the ball member 54 and to a handle 62 adapted to be gripped by an operator to rotate the ball member.

Figure 3:
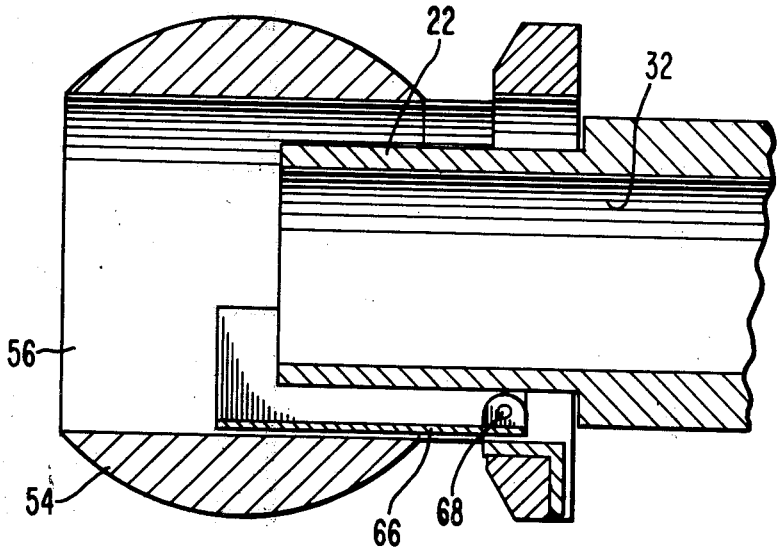

In order to protect the ball member 54, its valve seat 58 and the seals associated therewith, there is provided a collector means 64 that is interposed between the ball valve means 24 and the end of the first funnel means 22. As best seen in FIG. 3 of the drawing, the collector means 64 is in the form of a relatively thin collector door member 66 made of a material such as stainless steel and it is pivoted about a pin 68 the axis of which is transverse to the longitudinal axis of the first funnel means 22 and radially spaced therefrom. The collector door member 66 is a curved member having a radius of curvature approximately equal to the radius of the passage 56 in the ball member 54. The ball member 54 is located closely adjacent the convex surface of the collector door member 66 so that the ball member retains the collector door member in a closed position overlying the end of the passage 32 in the first funnel means 22. When the ball member 54 is rotated to its open position, the collector door member 66 pivots, usually by gravity, into its open position where it lies on or adjacent the surface of the passage 56 so that it does not obstruct flow from the passage 32 through the passage 56. When the ball member 54 is rotated back to its closed position, the rotation thereof automatically cams or lifts the collector door member 66 pivoting it about the pin 68 to its closed position.

It should be understood that with the ball valve means 24 in its closed position, the valve member 34 that controls flow from the supply hopper 12 cannot be opened. Rotation of the pinion 40 merely drives the end of the first funnel means 22 against the concave surface of the collector door member 66 which in turn is driven against the outer surface of the ball member 54. When the ball member 54 is rotated to its open position, the collector door member 66 falls to its open position and rotation of the pinion 40 drives the first funnel means 22 into the passage 56 as seen in FIG. 2 of the drawing. In this position, the valve member 34 is in its open position spaced from the free edge of the discharge passage 16 to allow flow of the raw material from the supply hopper through the passage 16, passage 32, and passage 56.

It should also be understood that the ball member 54 cannot be moved to its closed position when the valve member 34 is open. This is because the first funnel means 22 is located within the passage 56 in the ball member 54 when the valve member 34 is open. Thus rotation of the ball member 54 to its closed position causes that member to bind against the end of the first funnel means 22. Once the funnel means 22 has been driven to the closed position of the valve member 34, it is possible to close the valve means 24 and simultaneously and automatically therewith close the collector door member 66.

Since the valve member 34 cannot be opened with the ball valve means 34 is closed and since the ball valve means cannot be closed when the valve member is open, there can be no inadvertent flow of raw material to impinge on the surface of the ball member 54, its associated seat 58 or the associated seals. Moreover, since the end of the first funnel means 22 is located within the passage 56, the material discharged from the first funnel means cannot impinge on the surface of the ball member 54, its associated seat 58 or the associated seals. Finally, any material in the passage 32 when the valve member 34 is in the closed position is collected in the collector door member 66 which is automatically closed by the ball member 54 as it moves to its closed position. This collected material is discharged through the passage 56 when the collector door member 66 pivots into that passage and it cannot contact the outer surface of the ball member 54, its associated seat 56 or the associated seals.

The coupling means 26 is externally threaded along one end and is received in the other threaded portion 52 of the ball valve housing 50. The coupling means is formed with a passage 70 having an enlarged diameter portion and a smaller diameter portion that receives the flow of material from the passage 56 in the ball member 54 and discharges it into a passage 71 in the funnel member 28. The passage 71 is formed with a tapering enlarged diameter portion adjacent the coupling means 26. The funnel member 28 is normally carried by the inlet passage 20 in the feeding device 14. The first funnel means 22, the ball valve means 24, and the coupling means 26 are normally secured to the bottom of the support plate 18 of the supply hopper 12. To secure the funnel member 28 to the apparatus carried by the feeding device 14, there is provided a bellows member 73 having collars 72 at each end. One of the collars 72 is secured about a coupling member 74 used to couple the second funnel member 28 to a control valve means 76 that controls the flow of material from the funnel member 28 to the inlet passage 20. The other of the collar members 72 is secured to a flange member 78 that is, in turn, bolted to a flange member 80 formed on the coupling means 26. Use of the bellows member 73 allows for some misalignment between the coupling member 26 and the funnel member 28 and also assures a vacuum-tight connection between these members.

It should be understood that when the apparatus is to be used, the coupling means 26 is coupled to the funnel member 28 and that the ball valve means 24 and control valve means 76 are closed. After coupling, however, air is confined in the passages 70 and 71 and this air would recontaminate the raw material being transferred. To avoid recontamination, a fitting means 82 is located in the funnel member 28 and communicates with the passage 71. The fitting means 82 is adapted to be coupled to a source of inert gas such as argon. Adjacent the ball valve means 24, the coupling means 26 is formed with a pressure relief valve 84 of any conventional type that communicates with the passage 70. Before opening the ball valve means 24 or the control valve means 76, inert gas is fed into the passage 71 and 70 increasing the pressure therein and opening the pressure relief valve 84. At this point, the air trapped in the passages 71 and 70 is purged through the relief valve 84 and after a suitable period of time an atmosphere of inert gas is present. Thus, when the ball valve means 24 is opened there is no contaminating atmosphere to recontaminate the raw material previously purified in the supply hopper 12.

Transferring material from the supply hopper 12 to the feeding apparatus 14 is accomplished by connecting the coupling means 26 to the funnel member 28, then purging the passages 70 and 71 of air and filling them with an inert gas. The flow control valve 76 and the valve means 24 are opened, then the first funnel means 22 is driven, through the pinion 40 and rack 42, to the open position of valve member 34 so that the passages 32, 56, 70 and 71 are in communication. At this point the material flows under gravity from the hopper 12 to the feeding apparatus 14. Normally, the collector door member 66 opens when the ball member 54 opens by pivoting under the influence of gravity into the passage 56. If for some reason, it does not so pivot, the movement of the first funnel means 22 into the passage 56 will pivot the collector door member 66 to its open position.

It should be noted that the outer diameter of the first funnel means 22 is smaller than the diameter of the passage 56. With this relationship and the enlarged portions on the inlet side of the first funnel means 22, the coupling means 26 and the funnel member 28, the materal will not bridge or pack in the passages.

While in the foregoing there has been disclosed a preferred embodiment of the invention, it should be obviously to one skilled in the art that various changes and modifications can be made without the parting from the true spirit and scope of the invention as recited in the appended claims.

What is claimed is:

1. Apparatus for transferring material from one hopper to another, said apparatus comprising:

first funnel means having a passage therethrough, said first funnel means having a valve member adjacent one end and being adapted to be mounted adjacent to the bottom of the one hopper with the passage in communication with a feed opening in the bottom thereof, said first funnel means being movable between a first position wherein said valve member closes the feed opening and a second position wherein said valve opens the feed opening;

valve means adjacent the other end of said first funnel means, said valve means being movable between a closed position preventing flow from the passage and an open position allowing flow from the passage; and, collector means between said other end of first funnel means and said valve means, said collector means being movable between a closed position overlying said passage when said valve means is in its closed position and an open position spaced from said passage when said valve means is in its open position.

2. Appparatus in accordance with claim 1 wherein said collector means comprises a relatively thin door member pivotally mounted about an axis transverse to and spaced from the longitudinal axis of said passage.

3. Apparatus in accordance with claim 1 wherein said first funnel means is movable in a direction along its axis when said valve means is open whereby said valve member allows flow through said passage.

4. Apparatus in accordance with claim 1 wherein said valve means comprises a ball valve member having a passageway therethrough, said ball valve member holding said collector means in its closed position when said valve means is in its closed position and said collector means lying in said passageway when said valve means is in its open position.

5. Apparatus in accordance with claim 4 wherein said other end of said first funnel means is in said passageway when said first funnel means is in its second position.

6. Apparatus in accordance with claim 1 wherein said first funnel means is movable to said second position only when said valve means is in the open position and wherein said valve means is movable to its closed position only when said funnel means is in its first position.

7. Apparatus in accordance with claim 6 wherein said collector means cannot move to its open position unless said valve means is open and wherein said collector means is moved to its closed position by movement of said valve means from its open to closed position.

8. Apparatus in accordance with claim 1 including second funnel means adjacent said valve means, said second funnel means includind a passage in communication with the passage in said first funnel means when said valve means is in its open position.

9. Apparatus in accordance with claim 8 wherein said second funnel means is adapted to be mounted adjacent the other hopper, flow control valve means adjacent the end of said second funnel means farthest from said valve means, said flow control valve means being movable between a closed position preventing flow from said passage in said second funnel means and an open position allowing flow from said passage in said second funnel means, gas inlet means communicating with said passage in said second funnel means adjacent said flow control valve means and pressure relief valve means communicating with said passage in said second funnel means adjacent said valve means whereby said passage in said second funnel means can be purged of air and filled with an inert gas when said valve means and said flow control valve means are closed.

10. Apparatus for transferring material from one hopper to another said apparatus comprising:

first funnel means having a passage therethrough, said first funnel means having a valve member adjacent one end and being adapted to be mounted adjacent the bottom of the hopper with the passage in communication with a feed opening in the bottom of the hopper, said first funnel means being mounted for movement in a direction along its axis whereby said valve member is movable between a closed position adjacent the end of the feed opening in the bottom of the hopper and an open position spaced therefrom;

ball valve means adjacent the other end of said first funnel means said ball valve means including a ball member having a passage therethrough movable between a closed position wherein the outer surface of the ball member is closely adjacent said passage in said first funnel means and an open position wherein said passage in said ball member is aligned with said passage in said first funnel means and receives the other end of said first funnel means when said first funnel means is in a position corresponding to said open position of said valve member;

collector means between said first funnel means and said ball member, said collector means comprising a relatively thin door member pivotally mounted about an axis transverse to and spaced from the longitudinal axis of said passage for movement between a closed position overlying the end of said passage in said first funnel means and an open position overlying the inner surface of said passage in said ball member, said door member being retained in its closed position by the outer surface of said ball member when said ball member is in its closed position;

second funnel means having a passage therethrough, said second funnel means being adjacent said ball valve means and being arranged so that its passage is axially aligned with said passage in said first funnel means and receives material from said first funnel means when said ball member is in its open position;

said second funnel means being adapted to be mounted adjacent the inlet opening of the other hopper memeber, flow control valve means in said passage in said second funnel means said flow control valve means being located at the end of said second funnel means farthest from said ball valve means, said flow control valve means being movable between a closed position and an open position; and, gas inlet means communicating with said passage in said second funnel means adjacent said flow control valve means and pressure relief valve means communicating with said passage in said second funnel means adjacent said ball valve means whereby said passage in said second funnel means can be purged of air and filled with an inert gas when said flow control valve means and said ball valve means are closed.

* * * * *

UNITED STATES PATENT AND TRADEMARK OFFICE

CERTIFICATE OF CORRECTION

PATENT NO. : 4,325,419

DATED : April 20, 1982

INVENTOR(S) : Nicholas Francis Gubitose

It is certified that error appears in the above-identified patent and that said Letters Patent is hereby corrected as shown below:

Column 3, line 59, after "first" insert --funnel--.
Column 6, line 47, after "enlarged" insert --diameter--.
Column 6, line 53, "obviously" should be --obvious--.
Column 7, line 6, claim 1, after "of" insert --said--.
Column 7, line 44, claim 8, "includind" should be --including--.

Signed and Sealed this

*Thirtieth* Day of *November 1982*

[SEAL]

*Attest:*

GERALD J. MOSSINGHOFF

*Attesting Officer*

*Commissioner of Patents and Trademarks*